US007089711B2

(12) United States Patent
Timmerman et al.

(10) Patent No.: US 7,089,711 B2
(45) Date of Patent: Aug. 15, 2006

(54) FEEDER PROVIDED WITH AUTOMATIC SIZE RECOGNITION FOR A PACKAGING LINE

(75) Inventors: Ronald Timmerman, Zaandam (NL); Roberto Tuyn, Zaandam (NL)

(73) Assignee: Buhrs-Zaandam B.V., Zaandam (NL)

( * ) Notice: Subject to any disclaimer, the term of this patent is extended or adjusted under 35 U.S.C. 154(b) by 0 days.

(21) Appl. No.: 10/874,379

(22) Filed: Jun. 24, 2004

(65) Prior Publication Data

US 2005/0016133 A1 Jan. 27, 2005

(30) Foreign Application Priority Data

Jun. 25, 2003 (NL) ..... 1023745

(51) Int. Cl.
*B65B 57/12* (2006.01)
*B65B 35/02* (2006.01)

(52) U.S. Cl. ..... 53/58; 53/55; 53/504; 53/74; 53/550; 271/171

(58) Field of Classification Search ..... 53/550, 53/51, 55, 64, 74, 504, 58; 271/144, 171, 271/9.06, 223; B65B 35/02
See application file for complete search history.

(56) References Cited

U.S. PATENT DOCUMENTS 3,184,229 A * 5/1965 Weber ..... 271/3.24
3,712,020 A * 1/1973 Norr et al. ..... 53/74
4,381,637 A * 5/1983 Ballestrazzi et al. ..... 53/51
4,604,083 A * 8/1986 Barny et al. ..... 493/34
4,610,125 A * 9/1986 Meives et al. ..... 53/462
5,013,024 A * 5/1991 Stevens ..... 271/171
5,205,104 A * 4/1993 Nakashima et al. ..... 53/64
5,299,410 A * 4/1994 Freeman ..... 53/504
5,333,852 A 8/1994 Milillo et al.
5,671,593 A * 9/1997 Ginestra et al. ..... 53/504
6,901,820 B1 * 6/2005 Imahara ..... 73/865.8

FOREIGN PATENT DOCUMENTS

EP 0695706 A 2/1996
EP 0870678 A1 10/1998
EP 0985615 A2 3/2000
EP 1321367 A1 6/2003
FR 2794427 A 12/2000
JP 05229532 A * 9/1993 ..... 53/504
NL 1015123 C 1/2002

* cited by examiner

*Primary Examiner*—Stephen F. Gerrity
(74) *Attorney, Agent, or Firm*—Birch, Stewart, Kolasch & Birch, LLP

(57) ABSTRACT

A feeder for feeding products to be dispatched, such as, for instance, documents, periodicals, CDs, DVDs, and the like, to a conveyor of a packaging line, provided with transport pushers, the feeder being provided with a magazine for storing a stack of products, the dimensions of the magazine being settable through the setting of guides, wherein at least a number of the guides are in communication with a sensor, such that the position of the respective guide is known, while the control is arranged, on the basis of the signals coming from the sensors, to set at least one setting of a packaging line of which the feeder forms a part.

25 Claims, 10 Drawing Sheets

FEEDER PROVIDED WITH AUTOMATIC SIZE RECOGNITION FOR A PACKAGING LINE

This Non-provisional application claims priority under 35 U.S.C. §119(a) on Patent Application No(s). NL 1023745 filed in Nederland on Jun. 25, 2003, the entire contents of which are hereby incorporated by reference.

BACKGROUND OF THE INVENTION

1. Field of the Invention

The invention relates to a feeder for feeding products to be dispatched, such as, for instance, documents, periodicals, CDs, DVDs, and the like, to a conveyor of a packaging line, provided with transport pushers, the feeder being provided with a magazine for storing a stack of products, the dimensions of the magazine being settable through the setting of guides.

2. Description of Background art

Such a feeder is known from practice and is marketed by applicant. Descriptions are to be found, for instance, in the operating manual of the RF4-Feeder and in the operating manual of the "Big Foot" Shuttle Feeder, both of Buhrs-Zaandam The RF4-Feeder is a so-called drum feeder, whereby each time the bottommost product of a stack of products present in the magazine is pulled loose and is transported downwards via a gripper drum to be delivered there onto a conveying surface along which the transport pushers of the conveyor travel. In the case of a shuttle feeder such as, for instance, the Big Foot Shuttle Feeder of Buhrs-Zaandam, each time the bottommost product of a stack of products present in the magazine is transported forwards by means of a sliding table and discharged by further conveying means, such as, for instance, conveyor wheels and/or conveyor belts, to a lower conveying surface along which the transport pushers of a conveyor of a packaging line travel.

In the known apparatuses, the guides of the magazine are set manually, so that they match the dimensions of the product to be processed by the feeder. In the known apparatuses, it is of great importance that the moment of delivery of the product by a feeder be accurately geared to the position of a passing transport pusher, since the product should not end up on a transport pusher or far ahead of a transport pusher, but should be deposited onto the conveying surface with a trailing edge shortly before a transport pusher, so that the traveling speed of the product is substantially preserved and a reliable further conveyance of the product is effected. In practice, to that end, in the feeders according to the prior art, a number of operations are to be performed, whereby each feeder, in the so-called toggle position, which is a kind of test position, is phased to the conveyor by manual adjustment of a potentiometer. This needs to be performed for every feeder, which is a time consuming job which is at the expense of the production time of the packaging line.

It is known per se to store the product dimensions in the database of the control of the packaging line, so that these data can already be taken into account when setting the feeders. A drawback of this known method is that in practice it happens regularly that the data in the database do not correspond to the actual sizes of the documents. In practice, therefore, mostly the dimensions of the products are first measured and entered in the database, after which the subsequent setting and synchronization with the conveyor can take place automatically.

SUMMARY OF THE INVENTION

The object of the invention is to provide a feeder without the above-mentioned drawbacks, that is, a feeder where the setting time can be limited considerably, and where the prior measurement of the dimensions of the products that are to be processed by the respective feeder can be omitted.

To that end, according to the invention, the feeder of the type described in the opening paragraph hereof is characterized in that at least a number of guides are in communication with a sensor, such that the position of the respective guide is known, while the control is arranged, on the basis of the signals coming from the sensors, to set at least one setting of a packaging line of which the feeder forms a part.

In such a feeder, therefore, with the setting of the dimensions of the magazine through the positioning of the guide, automatically information is obtained about the dimensions of the product. This information is communicated to the control, so that the control can proceed to automatically set at least one setting of the packaging line of which the feeder forms a part. Since the dimensions of the magazine have to be set anyway when placing the product in it, the necessary dimension information is very efficiently obtained with the aid of the feeder according to the invention, without this entailing any loss of costly production time of the packaging line.

According to a further elaboration of the invention, it is particularly favorable when one of the settings to be set is the moment of delivery of a document from the feeder, while the control is arranged to determine this moment of delivery by processing the positions of the guides sensed with the sensors and the position of the transport pushers of the conveyor, such that the moment of delivery is automatically synchronized with the passing transport pushers.

Thus an automatic feeder synchronization is obtained, whereby the dimensions of the products present in the feeder are taken into account directly. It is therefore not necessary anymore to fill the database of the control of the packaging line manually with the dimensions of the various products to be processed. Moreover, the risk is thus eliminated that data already present in the database, concerning dimensions of products to be processed, deviate from the actual dimensions of the products to be processed. The chance of malfunctions is therefore reduced considerably.

The invention further provides a packaging line provided with a conveyor with transport pushers and at least one feeder according to the invention. Such a packaging line has the major advantage that the setting time required therefor is considerably reduced in that data about dimensions of products are automatically obtained when setting the guides of the feeder magazines. Such data can subsequently be used for setting various other matters to be set, pertaining to, for instance, a packaging station included in the packaging line.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Further elaborations of the feeder and the packaging line are described in the dependent claims and will be further clarified hereinafter on the basis of two exemplary embodiments, with reference to the drawing.

DETAILED DESCRIPTION OF THE PREFERRED EMBODIMENTS

Figure 1:
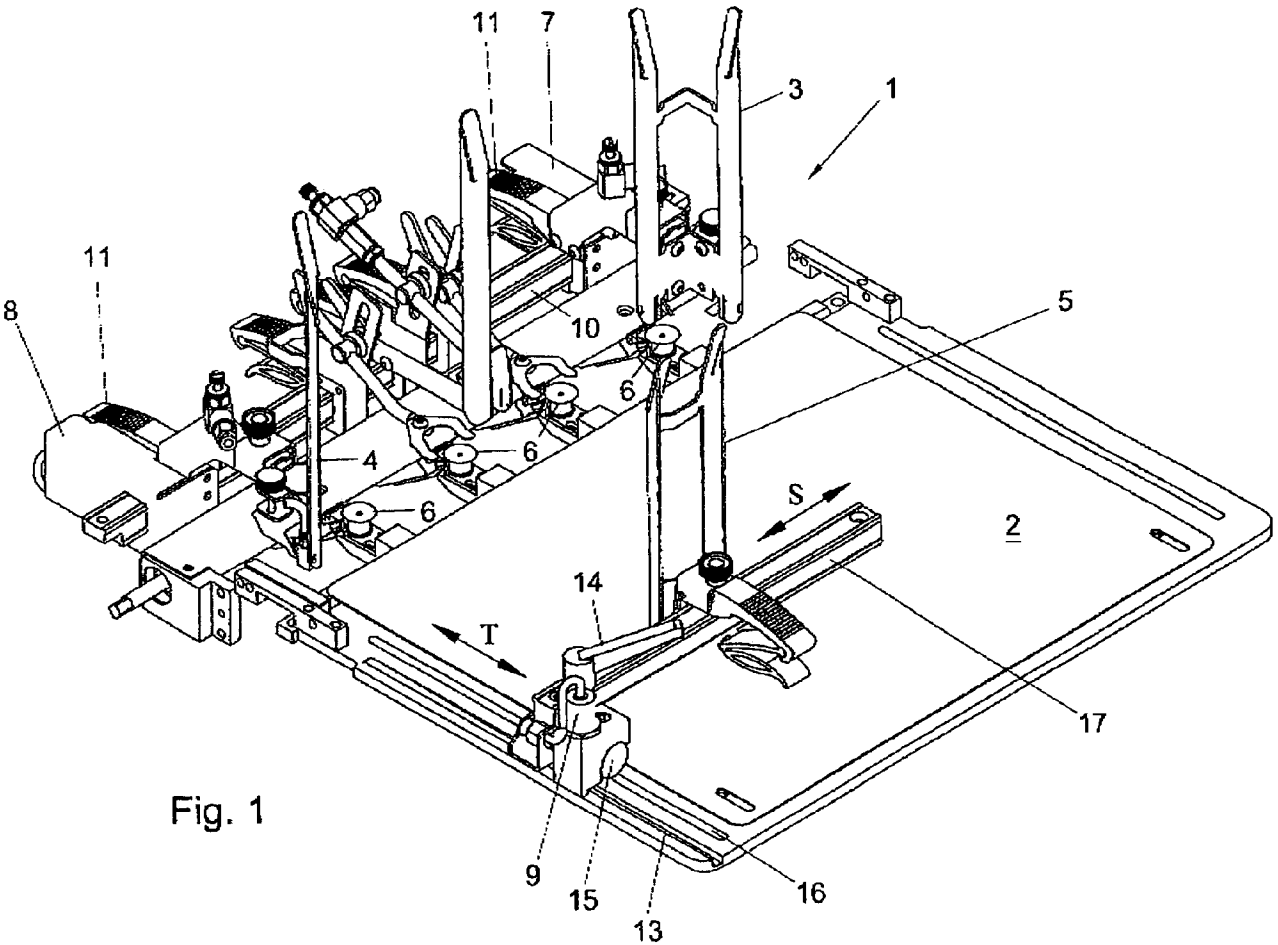
FIG. 1 shows a perspective view of the magazine section of a drum feeder.
Figure 2:
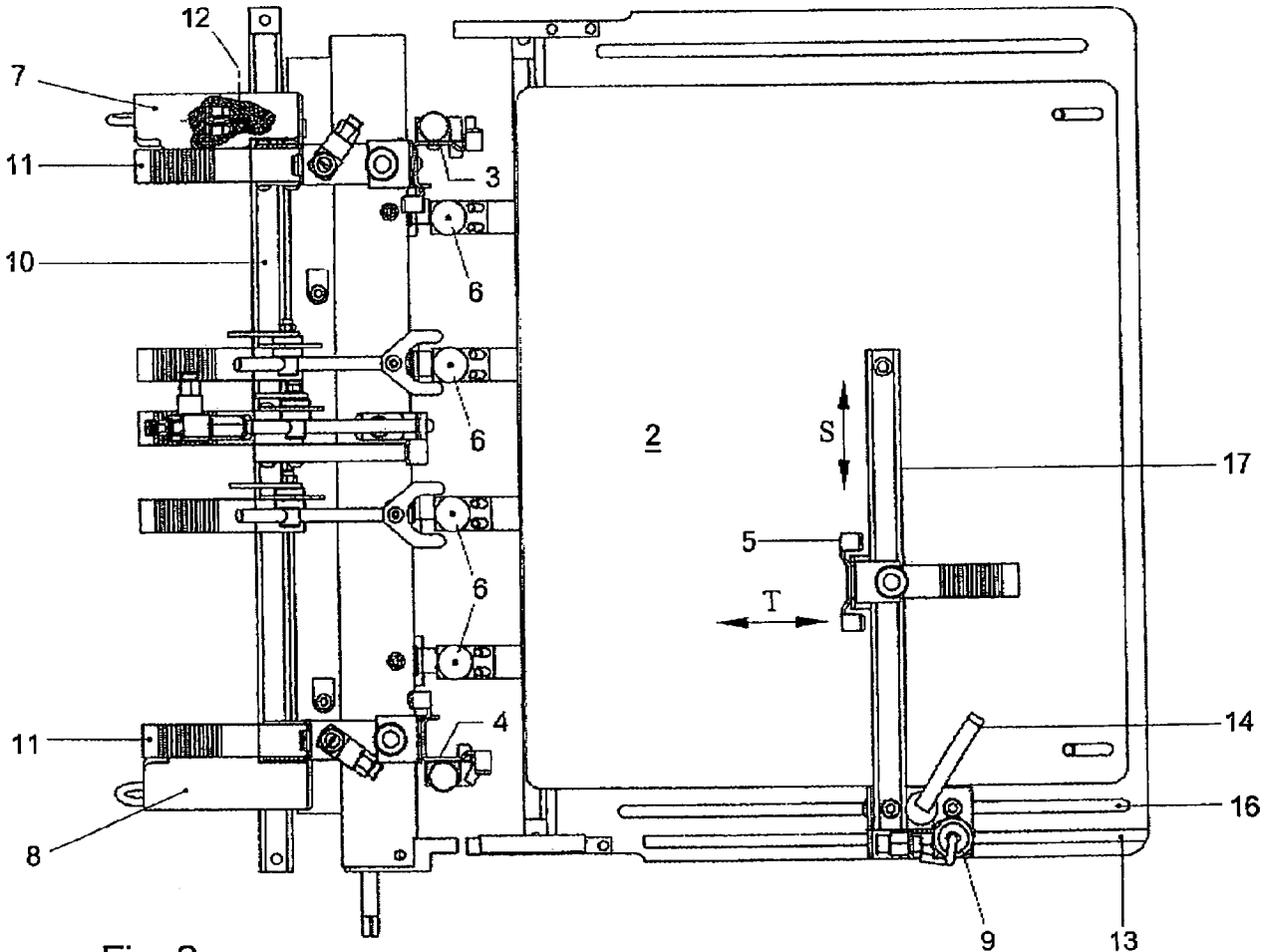
FIG. 2 shows a top plan view of the perspective view represented in FIG. 1.
Figure 3:
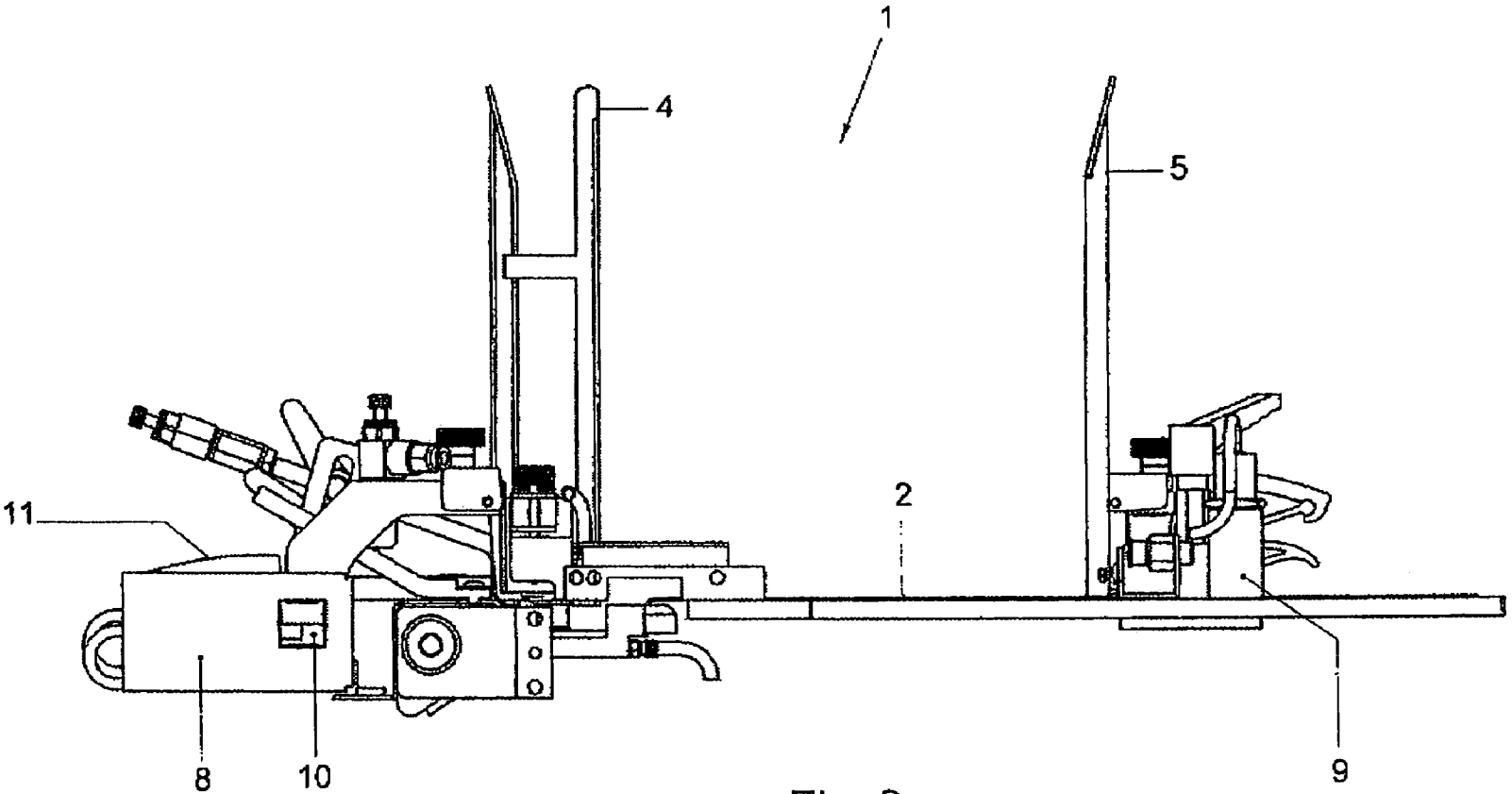
FIG. 3 shows a front view of the top plan view represented in FIG. 2.
Figure 4:
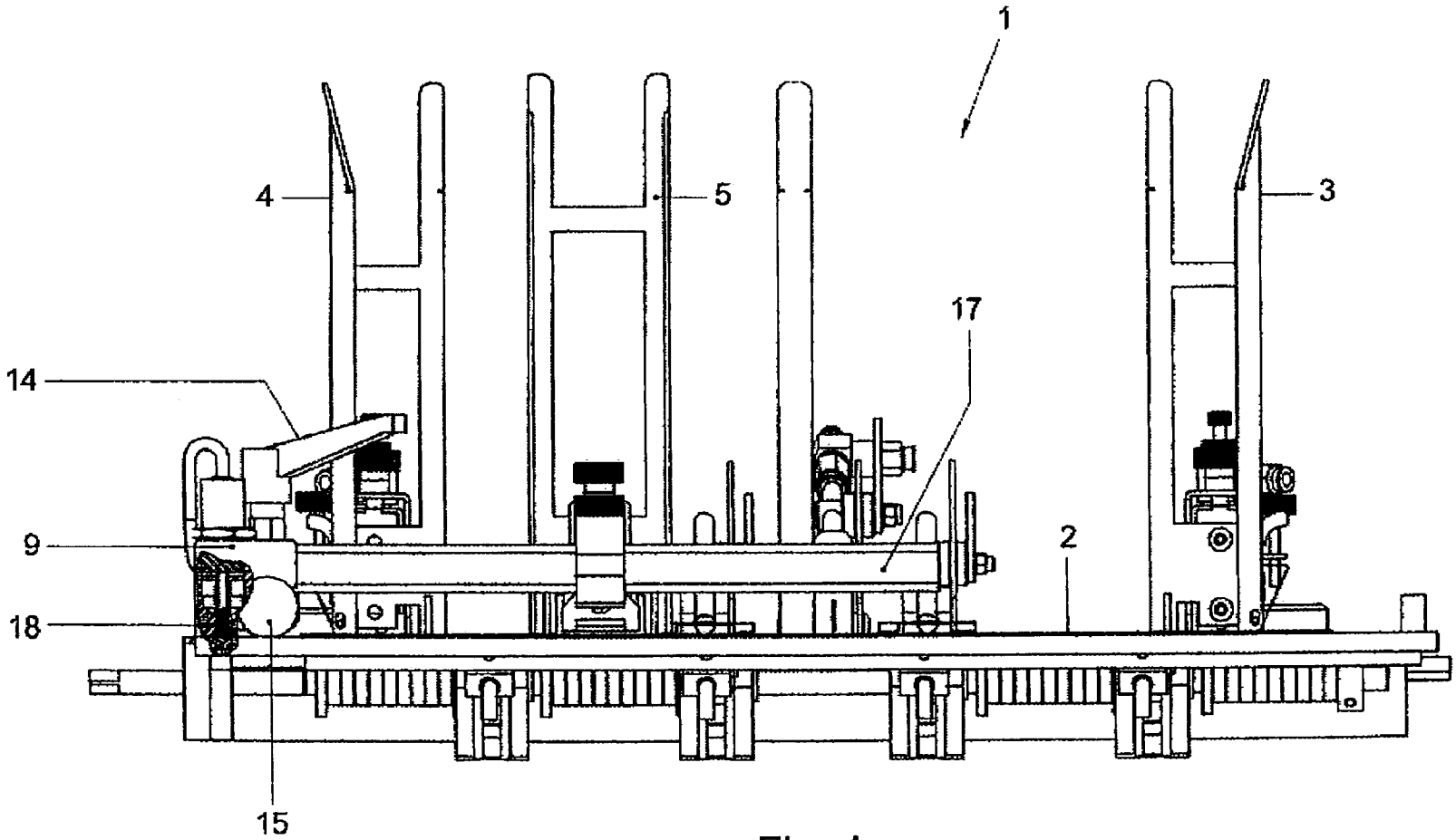
FIG. 4 shows a right-hand side view of the top plan view represented in FIG. 2.
Figure 5:
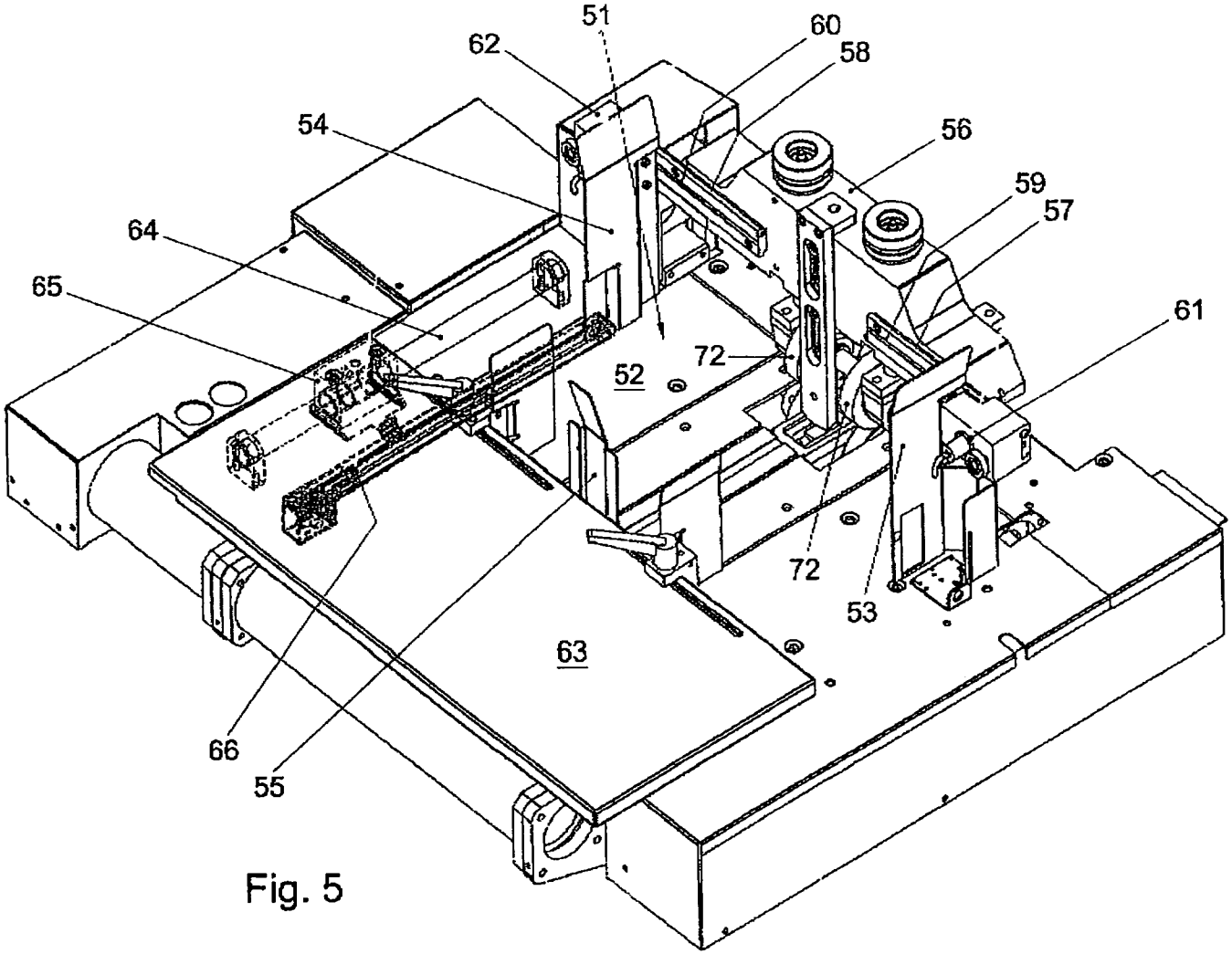
FIG. 5 shows a perspective top plan view of the magazine of a shuttle feeder.

The top plan view represented in perspective in FIG. 1 shows a magazine of a drum feeder, more particularly a drum feeder of the type as marketed by applicant under the type designation RF-4. For a comprehensive description of the RF-4 feeder, reference is made to the operating manual thereof having the reference number BDH-5301, of August 2002. The content of this operating manual is understood to be incorporated herein by reference. The operation of a drum feeder is known as such and requires no further elucidation here. Drum feeders are used especially for feeding products to be dispatched, such as, for instance, documents, periodicals and the like. The feeding is mostly done to a conveyor of a packaging line, provided with transport pushers. The transport pushers advance the product delivered by the feeder in a packaging line, for instance for the purpose of packaging the product delivered by the feeder. The feeder is provided with a magazine 1 whose lower end is bounded by a supporting table 2 and which is laterally bounded by guides 3, 4, 5. A bottommost product of a stack of documents present in the magazine 1 is pulled down a bit by suction cups 6, after which a gripper fitted on a rotary drum engages the front edge of the document and through rotation pulls the document from under the stack and transports it further to the conveyor provided with transport pushers. Since the conveyor with the transport pushers travels continuously, it is of importance that the downstream edge of a document to be delivered falls in front of the intended transport pusher. Therefore the timing of the moment of delivery relative to the travel of the transport pushers is of major importance. In the known feeder, this timing is set manually. Naturally, the timing depends on the size of the document, more particularly the position of the downstream edge relative to the upstream edge thereof. The exemplary embodiment of the drum feeder shown in FIGS. 1–4 is distinguished from the drum feeder known from practice in that the guides 3, 4, 5 which determine the size of the magazine 1 are in communication with a sensor 7, 8, 9 by means of which the position of the respective guides 3, 4, 5 is known. The control of the feeder is arranged, on the basis of the signals coming from the sensors 7, 8, 9, to set at least one setting of the packaging line of which the feeder forms a part. In the present exemplary embodiment, the angle guides 3, 4 which define the position of the opposed side edges and a leading edge of documents present in the magazine 1 are displaceably set up on a guide bar 10. With the aid of clamps 11, the guides 3 and 4 can be released and be moved along the guide bar 10. In the guide bar 10, a groove of a gradually increasing depth is provided. The sensors 7, 8 are inductive sensors in which a ferromagnetic pin 12 (see the partly cutaway sensor in FIG. 2) is set up so as to be movable in axial direction. The ferromagnetic pin 12 has one end resting in the groove of variable depth. Upon movement of the guide 3 and hence also of the sensor 7 along the guide bar 10, the end of the ferromagnetic pin 12 will come to abut at a different point in the groove of variable depth, as a result of which the ferromagnetic pin 12 undergoes an axial movement. In the sensor 7, this axial movement is sensed with the aid of induction, which results in a variation in the output signal of the respective sensor 7. Sensor 8 and sensor 9 work in a similar manner. In FIGS. 1 and 2 the groove 13 of variable depth is clearly visible. The guide 5 which abuts against the downstream edge of the documents to be delivered is arranged so as to be movable in the direction of the groove 13. With the aid of the sensor 9, through measurement of the depth of the groove, the position of the guide 5 is determined and passed on to the control of the feeder and/or the packaging line. The guide 5 can be moved in the direction T when the clamp 14 is released. Upon tightening of clamp 14, the cylindrical part 15 in the groove 16 is pressed upon, so that a pivoting of the guide bar 17 along which the guide 5 is movable in direction S is prevented. In FIG. 4 the sensor is represented in a partly cutaway view. Clearly visible is that this sensor 9 is also provided with a ferromagnetic pin 18, movable in axial direction, which has a free end abutting in the bottom of the groove 13.

It will be clear that also other sensors than the inductive sensors 7, 8, 9 represented here can be used to determine the positions of the guides 3, 4, 5.

Figure 6:
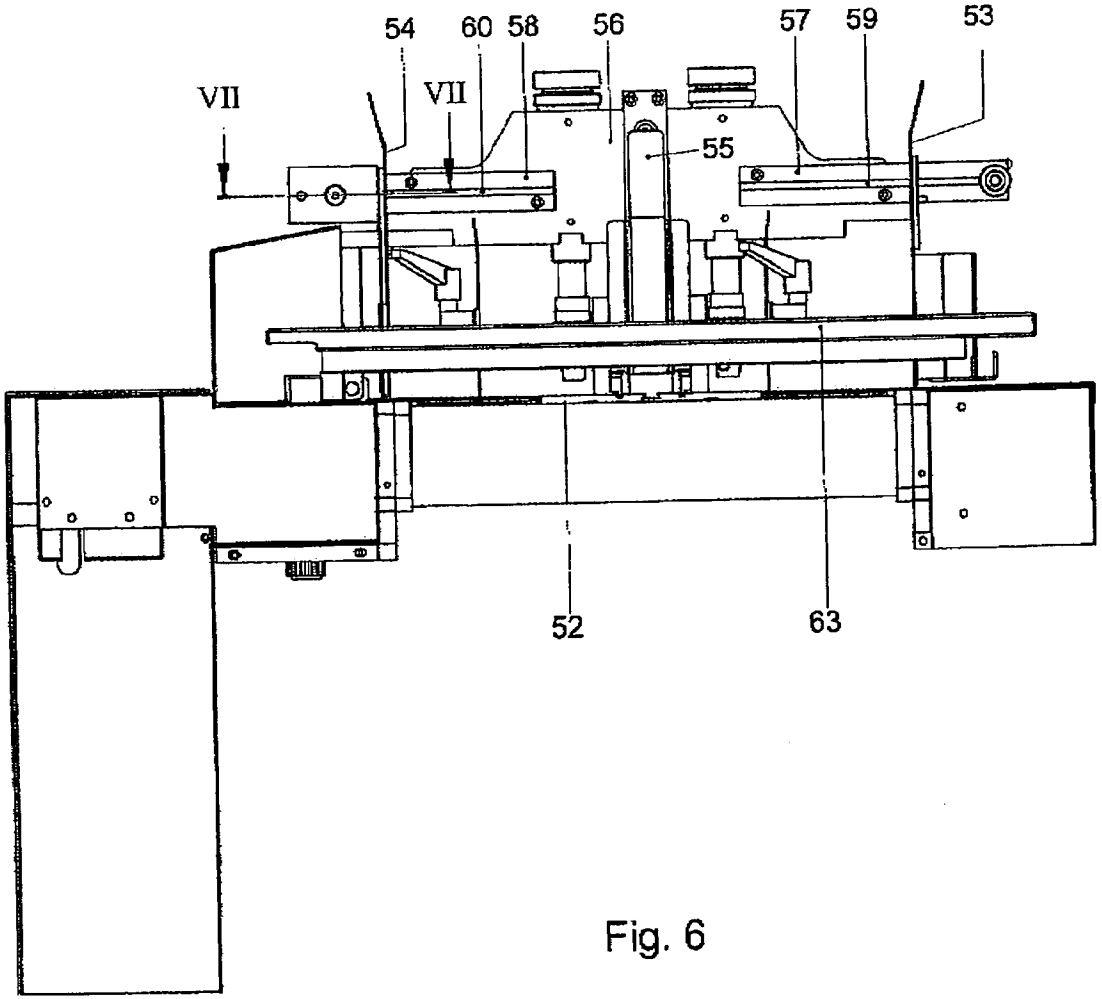
FIG. 6 shows a front view of the shuttle feeder shown in FIG. 5.
Figure 7:
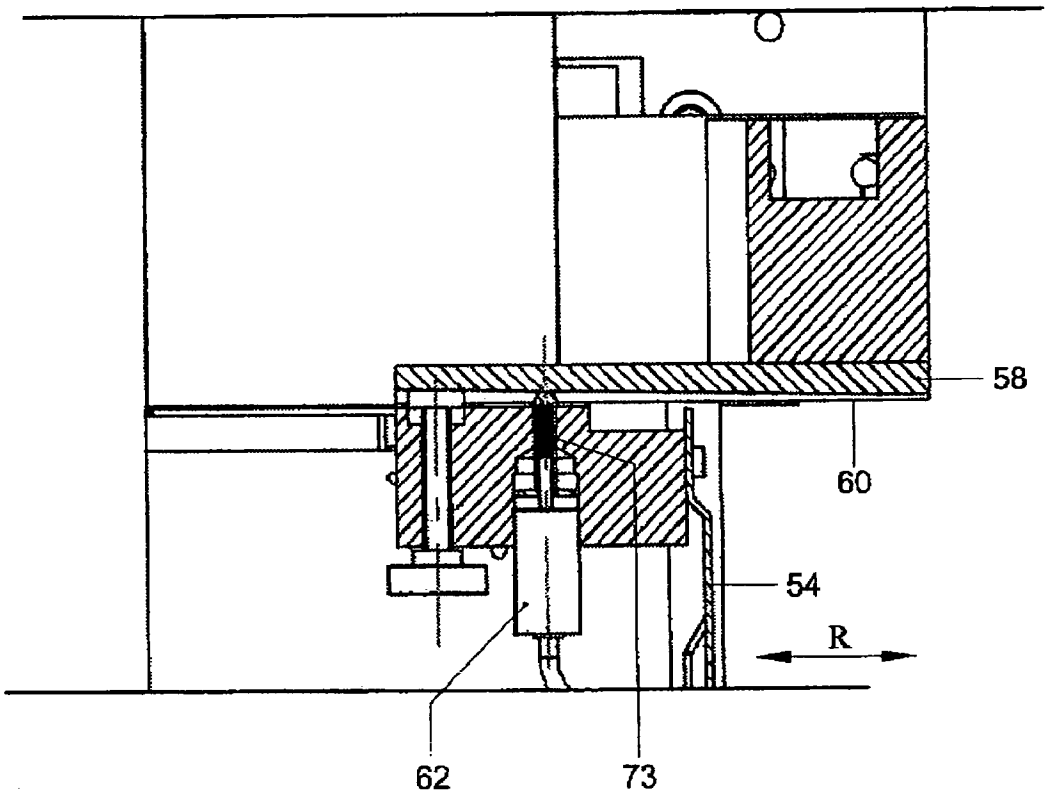
FIG. 7 shows a section along line VII—VII from FIG. 6.
Figure 8:
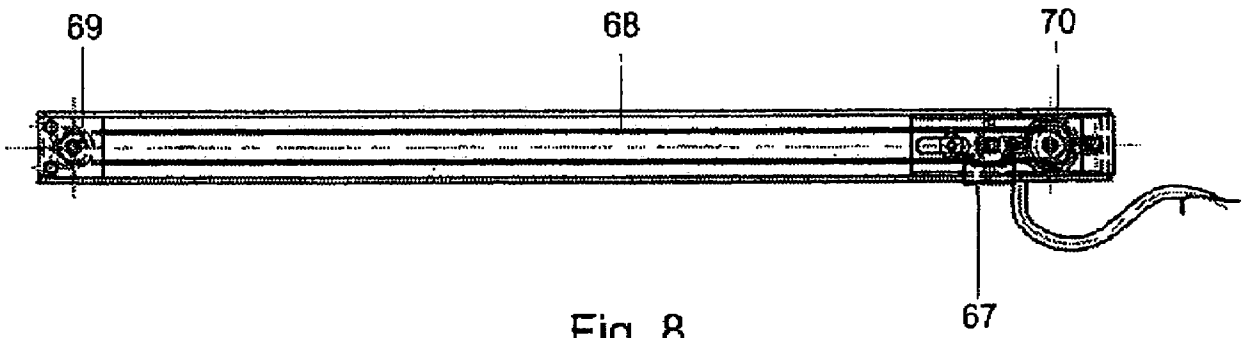
FIG. 8 shows a top plan view of the sensor means for sensing the rear stop.
Figure 10:
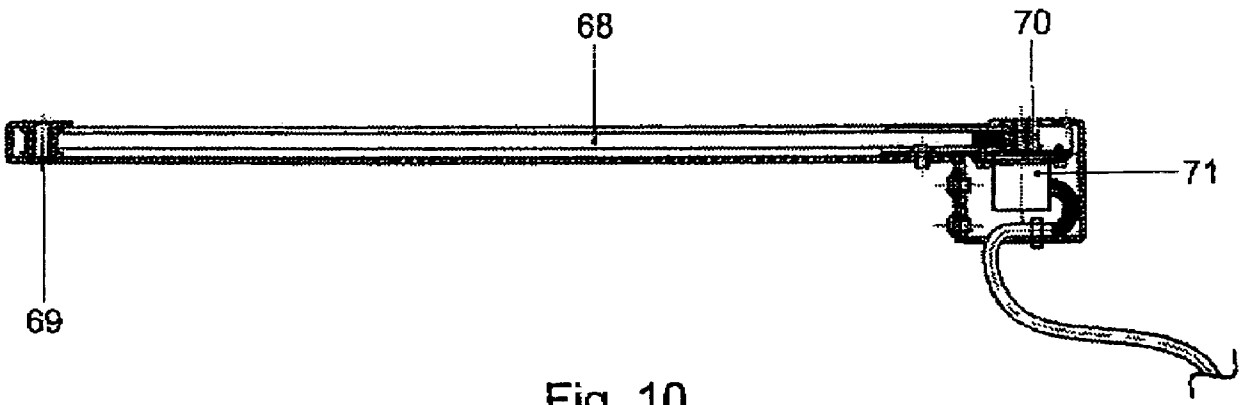
FIG. 10 shows a section along line X—X from FIG. 9.
Figure 9:
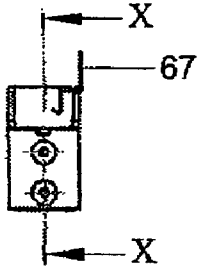
FIG. 9 shows a left-hand side view of FIG. 8.

The second exemplary embodiment, which is represented in FIGS. 5–10, is a so-called shuttle feeder. A shuttle feeder is known per se and is marketed by applicant under the name of "Big Foot". A comprehensive description of such a shuttle feeder is given in the operating manual of December 2002 with the code BDH-5248, the content of which is understood to be incorporated herein by reference. Such a shuttle feeder is provided with a magazine 51 which is bounded at the lower end by a sliding table 52 and which is laterally bounded by guides 53, 54 and which is bounded on a downstream side of the documents by a guide 55. The lateral guides 53, 54 are connected with a bridge 56 on which for each guide 53, 54 a ruler 57, 58, respectively, is provided, along which the guides 53, 54 are movable. Provided in the rulers 57, 58 are grooves 59, 60, whose depth varies in the longitudinal direction. Connected with each guide 53, 54 is a sensor 61, 62, respectively, of the type that is also utilized in the first exemplary embodiment, that is, an induction sensor which is provided with a ferromagnetic pin which is movable in axial direction and which has a free end abutting against the groove 59, 60 of variable depth. Upon movement of a guide 53, 54 along a respective ruler 57, 58, the sensor 61, 62 also moves along the respective groove 59, 60, so that the ferromagnetic pin in the sensor 61, 62 undergoes an axial displacement, which axial displacement brings about a variation in the output signal of the respective sensor 61, 62. Thus the position of a respective guide 53, 54 can be communicated to a control of the feeder and/or the packaging line. In FIG. 7, a cross section along line VII—VII from FIG. 6 is shown, in which the ruler 58 having therein the groove 60 of variable depth in longitudinal direction is clearly visible. Also clearly represented is the sensor 62 including the ferromagnetic pin 73 movable in axial direction. It is clear that upon displacement of the guide 54 in the direction R, the ferromagnetic pin 73 will move in axial direction and, as a result, the sensor 62 will produce a different output signal. The guide 55 abutting against the downstream edge of the documents present in the magazine 51 is determined by the position of the push-up table 63. The push-up table 63 is movable along the guide bar 64. Connected with the push-up table 63 is a guide block 65 which is bearing mounted on the guide bar 64. The guide block 65 is connected with sensor means 66 which are represented in more detail in FIGS. 8–10. The guide block 65 is connected with a fastening projection 67 which is connected with a toothed belt 68 which has been passed over an end pulley 69 and over an end pulley 70. An end pulley 70 is mounted on a shaft which is in communication with a sensor 71 whose output signal varies with the rotational position of the shaft. The sensor 71 can be, for instance, a potentiometer whose resistance varies upon rotation or an angle encoder. Therefore, upon movement of the push-up table 63 and, as a result thereof, movement of the guide 55, the guide block 65 is displaced which moves the projection 67 and, as a result, drives the toothed belt 68, which toothed belt 68 moves the shaft of the sensor 71 by way of end pulley 70, which entails a variation of the output signal of the sensor 71.

The operation of a shuttle feeder is known per se. The sliding table 52 performs a reciprocating movement and thereby moves the bottommost product of a stack of products present in the magazine 51 between the pull-in wheels 72. These pull-in wheels 72 provide for the farther transport of the respective product to the conveyor of the packaging line provided with transport pushers.

Figure 11:
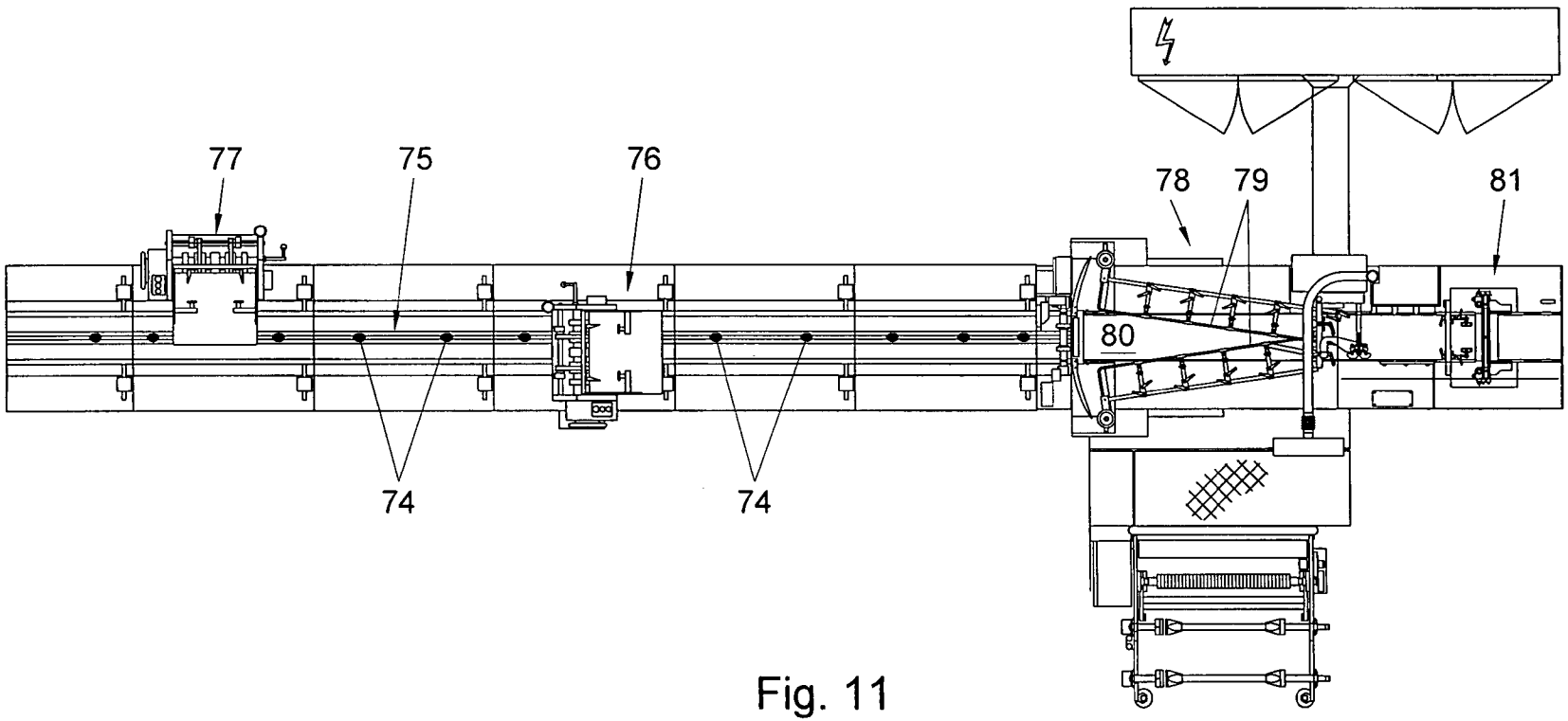
FIG. 11 shows a top plan view of a packaging line.
Figure 12:
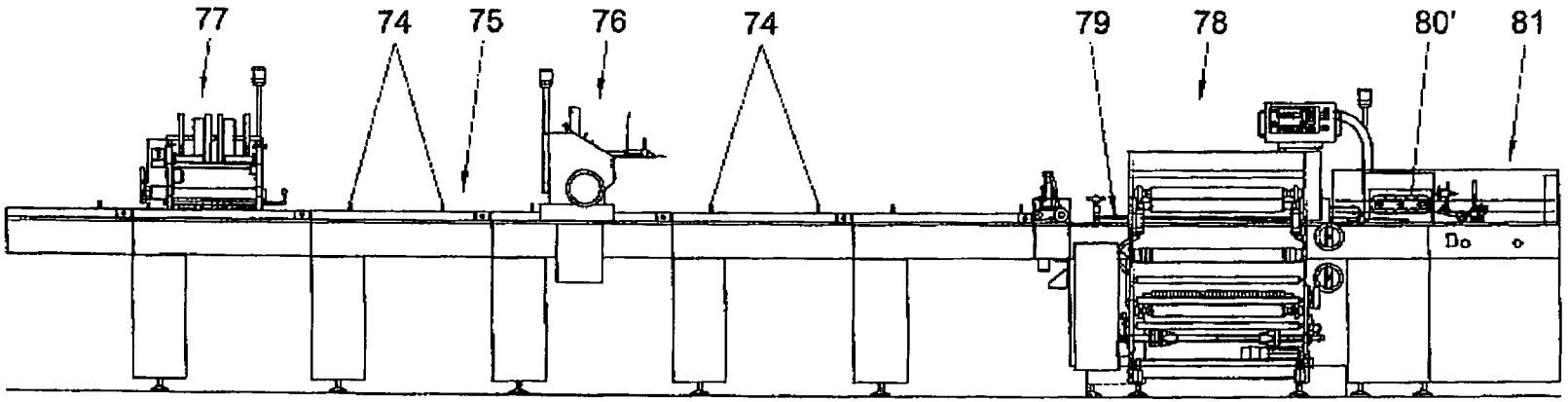
FIG. 12 shows a side view of the packaging line shown in FIG. 11.

FIG. 11 shows a top plan view of a conveyor 75 provided with transport pushers 74, along with a first feeder 76 arranged thereat, which is in an in line position and therefore delivers the documents in the conveying direction to the main conveyor 75. Further represented is a feeder 77 set up in an off line position, which delivers the documents transversely to the conveying direction of the conveyor 75, from the side. The feeders 76, 77 shown are preferably provided with a set-up sensor by means of which it can be sensed in what set-up the feeder is. It is then preferred that the control is arranged to involve signals from the set-up sensor in the setting of the at least one setting of the respective packaging line. Thus, an automatic synchronization of feeders, arranged both off-line and in-line, with the conveyor can be accomplished, taking into account the dimensions of the products present in the magazine 1 of a respective feeder.

Apart from the synchronization of the moment of delivery with the travel of the pusher conveyor, it is also possible, with the signals delivered by the sensors, to automatically set other features of the packaging line. Thus, the packaging line can be provided, for instance, with a packaging station 78. Such a packaging station 78 is generally provided with guides 79 and conveyor belts 80 for continuously forming a packaging tube from a planar paper or film web. In the packaging tube, the products delivered by the feeders 76, 77 and conveyed by the transport pushers 74 to the packaging station 78 are included. Downstream of the packaging station 78, there is generally a separating station 81 for separating discrete, packaged products from the packaging tube. Such a separating station 81, which is also known from practice and which is marketed by applicant, is generally provided with a cutting or sealing bar which performs a horizontal stroke and a vertical stroke. Preferably, the control of the packaging line is arranged to set the guides 79 of the packaging station automatically depending on the signals delivered by the sensors of the at least one feeder. In addition, the control is preferably arranged to set the horizontal and/or the vertical stroke of the cutting or sealing bars of the separating station 81 depending on the signals delivered by the sensors of the at least one feeder. Thus, the whole setting of the width of the packaging tube and the length of the packages can be automatically set by setting the guides of the feeders. With the setting of the guides of the feeders, the various dimensions of the products to be packaged are communicated to the control, after which an automatic synchronization of the various feeders with the main conveyor can take place, as well as an automatic setting of the guides of the packaging station and of the horizontal and/or the vertical stroke of the separating station.

The manual setting of the feeders is therefore superfluous. Moreover, the feeders will at the same time synchronize themselves with the main conveyor. Nor is it necessary anymore to input product dimensions in the database. Further, the invention provides the advantage that the database always contains the actual measurements of the products present in the magazine. Furthermore, the invention provides the possibility of positioning the products asymmetrically in the feeder, through an asymmetrical positioning of the side guides. For this purpose, no data need to be inputted in the database. Owing to the size data becoming available automatically when the product guides have been placed against the product, the system is very easy to handle and requires hardly any training.

It will be clear that the invention is not limited to the exemplary embodiments described but that various modifications are possible within the framework of the invention as defined by the claims.

The invention claimed is:

1. A feeder for feeding products to a conveyor of a packaging line, the conveyor being provided with transport pushers, said feeder comprising:

a magazine for storing a stack of products, the magazine including a plurality of guides, the dimensions of the magazine being settable through the setting of the plurality of guides; and at least one sensor in communication with at least one of the plurality of guides, a position of the at least one guide being sensed by the at least one sensor, wherein a signal from the at least one sensor can be sent to a control of the packaging line, to set at least a moment of delivery of a document from the feeder, and the control is arranged to determine the moment of delivery by processing the position of the at least one guide sensed by the at least one sensor and the position of the transport pushers of the conveyor, such that the moment of delivery is automatically synchronized with the transport pushers.

2. The feeder according to claim 1, wherein an ascending groove is provided along a path of movement of the at least one guide, the at least one sensor is connected with the guide, and the signal from the at least one sensor varies with a depth of the ascending groove.

3. The feeder according to claim 2, wherein the at least one sensor is an induction sensor, having therein a movable ferromagnetic pin that is pressed under spring action against a bottom of the ascending groove.

4. The feeder according to claim 1, wherein the at least one guide is connected via a transmission to the at least one sensor, and the at least one sensor is a position sensor.

5. The feeder according to claim 4, wherein the transmission is a gear/rack transmission, the gear adjusts the at least one sensor, and the rack extends along a path of movement of the at least one guide.

6. The feeder according to claim 4, wherein the transmission is a toothed belt/gear transmission, the gear adjusts the at least one sensor, and the toothed belt passes over the gear and has one end connected to the at least one guide.

7. The feeder according to claim 4, wherein the position sensor is an angle encoder.

8. The feeder according to claim 4, wherein the position sensor is a potentiometer.

9. The feeder according to claim 1, wherein the feeder is of the shuttle type.

10. The feeder according to claim 1, wherein the feeder is of the drum type.

11. The feeder according to claim 1, wherein the feeder can be set up both in-line and off-line, the feeder further comprising a set-up sensor that senses a set-up of the feeder, the control receiving signals from the set-up sensor to set at least one other setting of the packaging line.

12. A packaging line, comprising:

a conveyor provided with transport pushers;

a control that controls a plurality of settings of the packaging line; and a feeder, said feeder comprising:

a magazine for storing a stack of products, the magazine including a plurality of guides, the dimensions of the magazine being settable through the setting of the plurality of guides; and at least one sensor in communication with at least one of the plurality of guides, a position of the at least one guide being sensed by the at least one sensor, wherein a signal from the at least one sensor can be sent to the control to set at least one of the plurality of settings of the packaging line.

13. The packaging line according to claim 12, further comprising:

a packaging station provided downstream of the conveyor, the packaging station being provided with guides and conveyor belts for continuously forming a packaging tube from a planar paper or film web, the products delivered by the at least one feeder and conveyed by the transport pushers to the packaging station being insertable into the packaging tube; and a separating station provided for separating discrete, packaged products from the packaging tube, wherein the control is arranged to automatically set the guides of the packaging station depending on the signal delivered by the at least one sensor.

14. The packaging line according to claim 13, wherein the separating station comprises a cutting or sealing bar that performs a horizontal stroke and a vertical stroke, the control being arranged to set the horizontal and/or the vertical stroke depending on the signal delivered by the at least one sensor.

15. The packaging line according to claim 12, wherein the at least one of the plurality of settings of the packaging line is a moment of delivery of a document from the feeder, and the control is arranged to determine the moment of delivery by processing the position of the at least one guide sensed by the at least one sensor and the position of the transport pushers of the conveyor, such that the moment of delivery is automatically synchronized with the transport pushers.

16. The packaging line according to claim 12, wherein an ascending groove is provided along a path of movement of the at least one guide, the at least one sensor is connected with the guide, and the signal from the at least one sensor varies with a depth of the ascending groove.

17. The packaging line according to claim 16, wherein the at least one sensor is an induction sensor, having therein a movable ferromagnetic pin that is pressed under spring action against a bottom of the ascending groove.

18. The packaging line according to claim 12, wherein the at least one guide is connected via a transmission to the at least one sensor, and the at least one sensor is a position sensor.

19. The packaging line according to claim 18, wherein the transmission is a gear/rack transmission, the gear adjusts the at least one sensor, and the rack extends along a path of movement of the at least one guide.

20. The packaging line according to claim 18, wherein the transmission is a toothed belt/gear transmission, the gear adjusts the at least one sensor, and the toothed belt passes over the gear and has one end connected to the at least one guide.

21. The packaging line according to claim 18, wherein the position sensor is an angle encoder.

22. The packaging line according to claim 18, wherein the position sensor is a potentiometer.

23. The packaging line according to claim 12, wherein the feeder is of the shuttle type.

24. The packaging line according to claim 12, wherein the feeder is of the drum type.

25. The packaging line according to claim 12, wherein the feeder can be set up both in-line and off-line, the feeder further comprising a set-up sensor that senses a set-up of the feeder, the control receiving signals from the set-up sensor to set at least one other setting of the packaging line.

* * * * *